US011149729B2

(12) United States Patent
George et al.

(10) Patent No.: US 11,149,729 B2
(45) Date of Patent: Oct. 19, 2021

(54) PUMP WITH BLEED MECHANISM FOR REDUCING CAVITATION

(71) Applicant: EATON INTELLIGENT POWER LIMITED, Dublin (IE)

(72) Inventors: Jubin Tom George, Pune (IN); Kishor Ramdas Borkar, Pune (IN); Robert Joseph Nyzen, Hiram, OH (US)

(73) Assignee: Eaton Intelligent Power Limited, Dublin (IE)

( * ) Notice: Subject to any disclaimer, the term of this patent is extended or adjusted under 35 U.S.C. 154(b) by 204 days.

(21) Appl. No.: 16/038,885

(22) Filed: Jul. 18, 2018

(65) Prior Publication Data

US 2019/0024657 A1 Jan. 24, 2019

Related U.S. Application Data

(60) Provisional application No. 62/533,903, filed on Jul. 18, 2017.

(51) Int. Cl.
*F04C 2/18* (2006.01)
*F04C 2/08* (2006.01)

(52) U.S. Cl.
CPC ..... *F04C 2/18* (2013.01); *F04C 2/088* (2013.01)

(58) Field of Classification Search
CPC ..... F04C 2/088; F04C 2/18; F04C 13/007; F04C 15/0049; F04C 15/0053; F04C 18/088; F04C 29/0035; F04C 2/123; F01C 1/088; F01C 1/123; F01C 1/126; F01C 1/14; F01C 1/24
See application file for complete search history.

(56) References Cited

U.S. PATENT DOCUMENTS 1,870,192 A * 8/1932 Butler ..... F04C 13/008 222/236
3,431,862 A * 3/1969 Bottoms ..... F04C 15/0049 418/206.5
3,985,063 A * 10/1976 Lemon ..... F16D 25/14 91/31

(Continued)

FOREIGN PATENT DOCUMENTS

DE 102008007464 A1 * 9/2008 ..... F04C 2/088
EP 0754859 A2 * 1/1997 ..... F04C 2/088
GB 1547944 * 7/1979 ..... F04C 2/088

OTHER PUBLICATIONS

EP0754859 translation (Year: 2020).*

*Primary Examiner* — Devon C Kramer
*Assistant Examiner* — David N Brandt
(74) *Attorney, Agent, or Firm* — Fay Sharpe LLP

(57) ABSTRACT

A gear pump assembly includes a drive gear having a plurality of circumferentially spaced teeth, and a driven gear likewise having a plurality of circumferentially spaced teeth positioned for intermeshing engagement between the drive and driven gears via the teeth. A bleed mechanism directs carryover fluid from a discharge side of a bearing dam to an inlet side of the bearing dam in order to supply the carryover fluid to a carryover volume disposed between mating drive gear teeth and driven gear teeth. The bleed mechanism including a passage communicating with at least one of (i) a gear face of the drive gear, (ii) a gear face of the driven gear; or (iii) a bottom of a gear tooth profile adjacent a root region between adjacent gear teeth.

20 Claims, 18 Drawing Sheets

(56) References Cited

U.S. PATENT DOCUMENTS

| | | | | |
|---|---|---|---|---|
| 5,180,299 | A * | 1/1993 | Feuling | F04C 2/088<br>418/190 |
| 2015/0147211 | A1* | 5/2015 | Czerwonka | F04C 2/088<br>418/1 |
| 2017/0268507 | A1* | 9/2017 | Ribarov | F04C 2/18 |

* cited by examiner

PUMP WITH BLEED MECHANISM FOR REDUCING CAVITATION

This application claims the priority benefit of U.S. provisional application 62/533,903, filed 18 Jul. 2017, the entire disclosure of which is expressly incorporated herein by reference.

BACKGROUND

This invention relates to a pump assembly such as a gear pump assembly used, for example, as a main stage in an engine fuel pump.

Gear pump assemblies inherently have difficulty with filling in high speed and high pressure applications which potentially causes damaging cavitation on the gears and bearings. This is due to the limited space available to place inlet and discharge ports, along with the rapid volume change during this transition. Traditional gear pumps use geometric variations of the non-working side of the gear teeth in conjunction with contours on the bearing faces to port the fluid to inlet or discharge. However, in larger face width and/or higher speed applications, cavitation can increase without a way to mitigate the cavitation. As a result, gear pumps traditionally are prone to cavitation due to the short amount of time available to fill the gear mesh. Unfortunately there is a limited area available to fill the gear mesh region. Moreover, as gear pumps get larger and rotate faster, this filling becomes more challenging and tends to result in larger amounts of cavitation.

Commonly, a gear pump assembly has two external toothed gears (one is a drive gear and the other is a driven gear) located on respective, parallel, first (drive) and second (driven) shafts, and two pairs of bearings that support the first and second shafts, respectively, located on either axial side of the gear teeth. Typically, the bearings are a split bearing design as is well known in the industry, and each bearing includes a bearing dam that prevents high pressure (discharge) fluid from directly leaking to the low pressure (inlet) side. As the gear teeth rotate at high speed to generate the required flow, there is a carryover volume which is taken from the discharge side and recirculated to the inlet side of the pump assembly. This carryover volume is not trapped as such, but is carried over the bearing dam. Typical cavitation in the gear intermesh is caused because of a rapid opening of the gear mesh volume in the inlet (low-pressure) zone which causes localized, lower pressure pockets leading to focused cavitation and erosion.

A need exists for an improved arrangement that (i) limits and/or avoids gear intermesh starvation, (ii) reduces cavitation, and/or (iii) generates additional porting area to improve filling, i.e., providing at least one or more of the above-described features, as well as still other features and benefits described below.

SUMMARY

An improved gear pump assembly includes additional bleed flow to reduce cavitation and/or additional porting area to improve filling and thereby reduce cavitation.

In one preferred arrangement, a feature is provided on the drive gear of a gear pump, namely a lower pressure ported bleed path is provided on each of the gear teeth. This bleed path is ported to inlet pressure (i.e., lower pressure) and provides bleed flow to the carryover volume in between mating drive and driven gear teeth. Due to this additional bleed flow, gear intermesh starvation is addressed and cavitation occurrence in the gear intermesh region is reduced.

In another preferred arrangement, a feature is provided on the driven gear of a gear pump, namely a high pressure ported bleed path is provided on each of the gear teeth. This bleed path is ported to discharge pressure (i.e., high pressure) and provided bleed flow to the carryover volume in between mating drive and driven gear teeth. Due to this additional bleed flow, gear intermesh starvation is addressed and cavitation occurrence in the gear intermesh region is reduced.

In still another preferred arrangement, a unique manner of generating additional porting area is provided to improve filling and thus reduce cavitation.

The gear pump assembly includes a drive gear having a plurality of circumferentially spaced teeth, and a driven gear likewise having a plurality of circumferentially spaced teeth positioned for intermeshing engagement between the drive and driven gears via the teeth. A bleed mechanism directs carryover fluid from a discharge side of a bearing dam to an inlet side of the bearing dam in order to supply the carryover fluid to a carryover volume disposed between mating drive gear teeth and driven gear teeth. The bleed mechanism including a passage communicating with at least one of (i) a gear face of the drive gear, (ii) a gear face of the driven gear; and/or (iii) a bottom of a gear tooth profile adjacent a root region between adjacent gear teeth.

The passage may include at least one of a first passage portion extending through a tooth of the drive gear and/or driven gear.

The first passage portion may extend in a direction substantially parallel to opposite faces of the tooth of the drive and/or driven gear.

The passage may include a second passage portion communicating at a first end with the first passage portion within the drive and/or driven gear tooth, and communicating at a second end with a face of the tooth of the drive and/or driven gear, respectively.

The second passage portion may be inclined relative to normal to one of the tooth faces of the drive and/or driven gear.

The second passage portion may communicate with a non-working, trailing face of the gear tooth.

The second passage portion may include first and second openings that are inclined relative to normal to one of the tooth faces of the drive and/or driven gear.

The first and second passage portions may have the first and second openings converging toward one another.

The gear pump assembly may further include an enlarged counter bore portion at an inlet end of the first passage portion that communicates with the inlet side of the gear pump.

The bleed mechanism passage may include an axial opening that communicates with a side of the tooth at one end and that communicates with the root region disposed between adjacent gear teeth at the bottom of the gear tooth profile.

The bleed mechanism passage may receive bleed fluid flow from the inlet side of the pump via the axial opening before directing the bleed fluid flow toward a center of the gear mesh.

The bleed mechanism passage may include a connecting portion at the bottom of the gear tooth profile.

The connecting portion may be angled to direct the bleed flow toward a face of the bearing.

The connecting portion may extend from the axial opening in the tooth of the drive gear to the non-working face of the drive gear tooth, or the connecting portion may extend from the axial opening in the tooth of the driven gear to the non-working face of the driven gear tooth.

The connecting portion may extend from the axial opening in the tooth of the driven gear to the working face of the driven gear.

The connecting portion may extend from the axial opening in the tooth of the drive gear to the working face of the drive gear tooth.

The connecting portion may extend from the axial opening in the tooth of the driven gear to the non-working face of the driven gear tooth.

The gear pump assembly may further include timing slots in bearing end faces to control flow into the axial opening.

A primary advantage is limiting and/or avoiding gear intermesh starvation.

Another benefit resides in reduced cavitation.

Still another advantage is associated with generating additional porting area to improve filling.

Still other benefits and advantages of the present disclosure will become more apparent from reading and understanding the following detailed description.

DETAILED DESCRIPTION

Figure 1A:
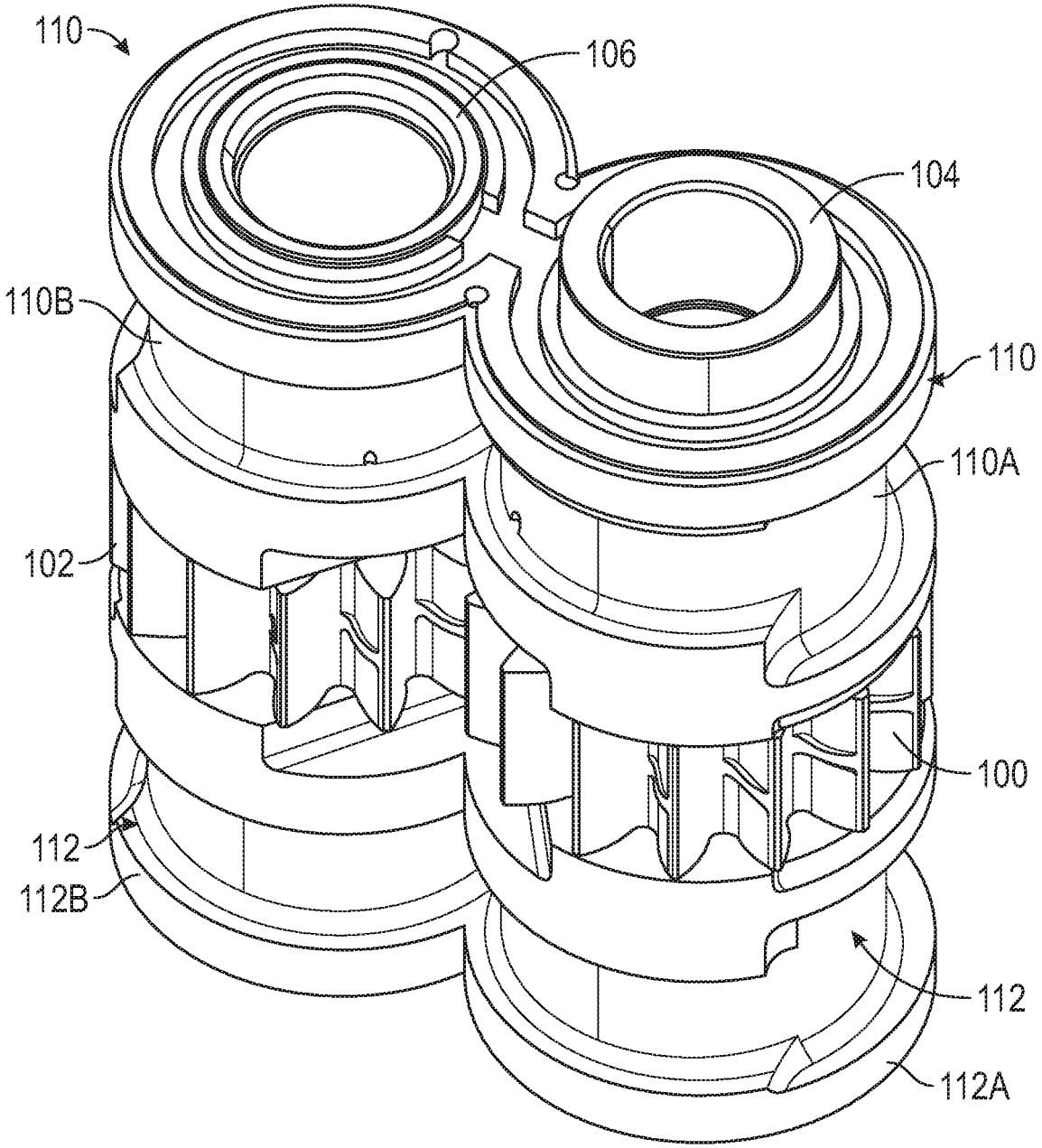
FIGS. 1A-1D are views of the gears and bearings stack design in a typical gear pump.

A more complete understanding of the components, processes and apparatuses disclosed herein can be obtained by reference to the accompanying drawings. These figures are merely schematic representations based on convenience and the ease of demonstrating the present disclosure and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/components/steps and permit the presence of other ingredients/components/steps. However, such description should be construed as also describing compositions, articles, or processes as "consisting of" and "consisting essentially of" the enumerated ingredients/components/steps, which allows the presence of only the named ingredients/components/steps, along with any impurities that might result therefrom, and excludes other ingredients/components/steps.

Figure 1B:
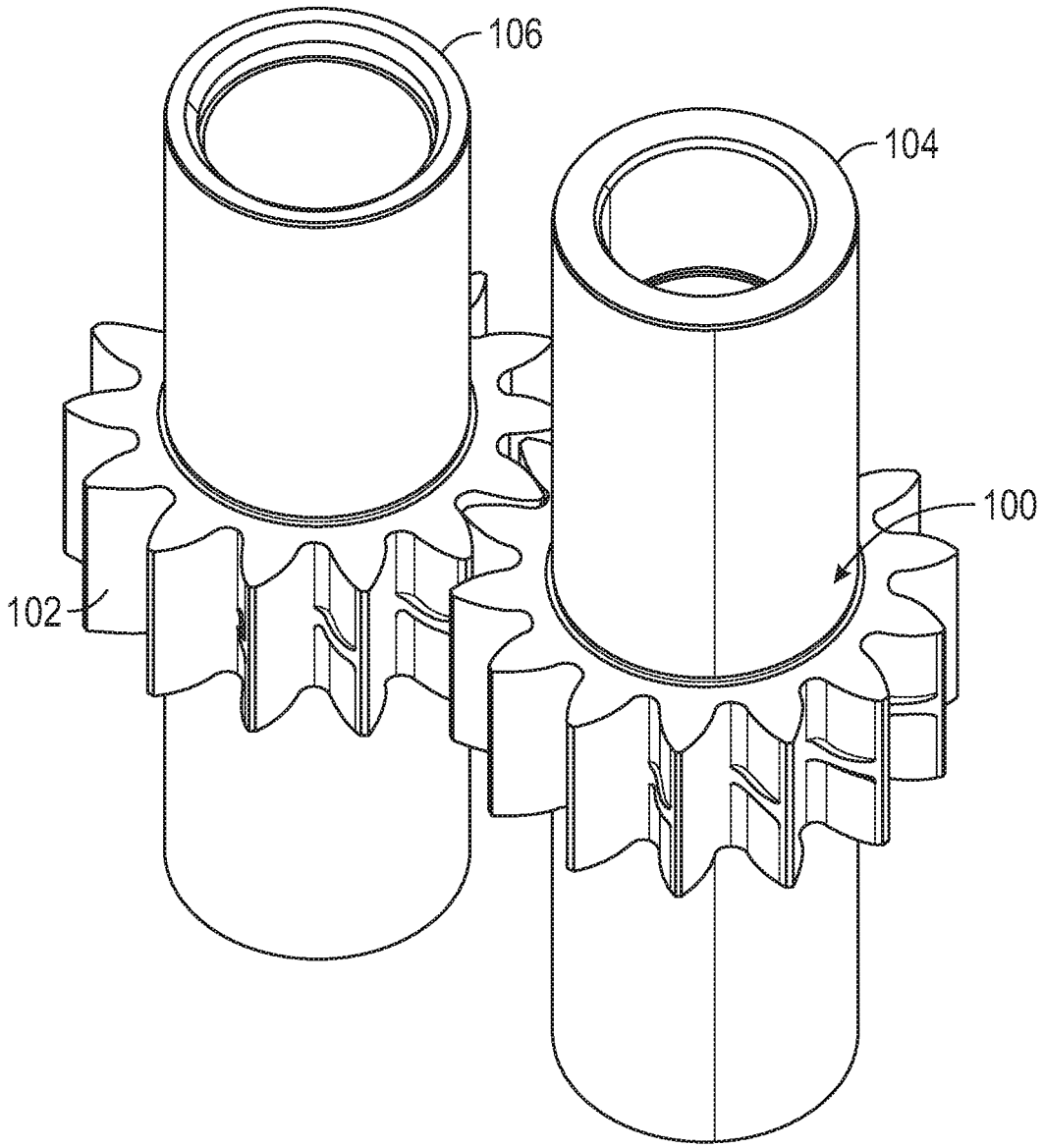
Figure 1C:
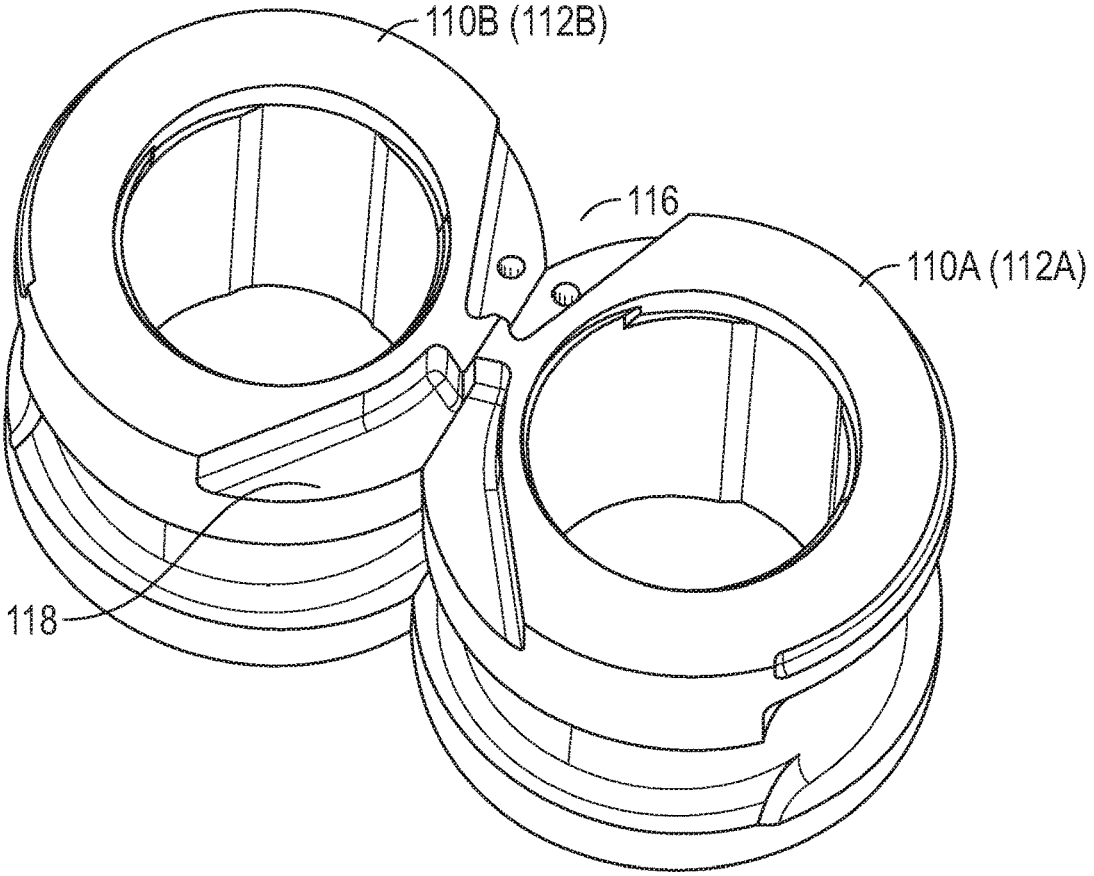
Figure 1D:
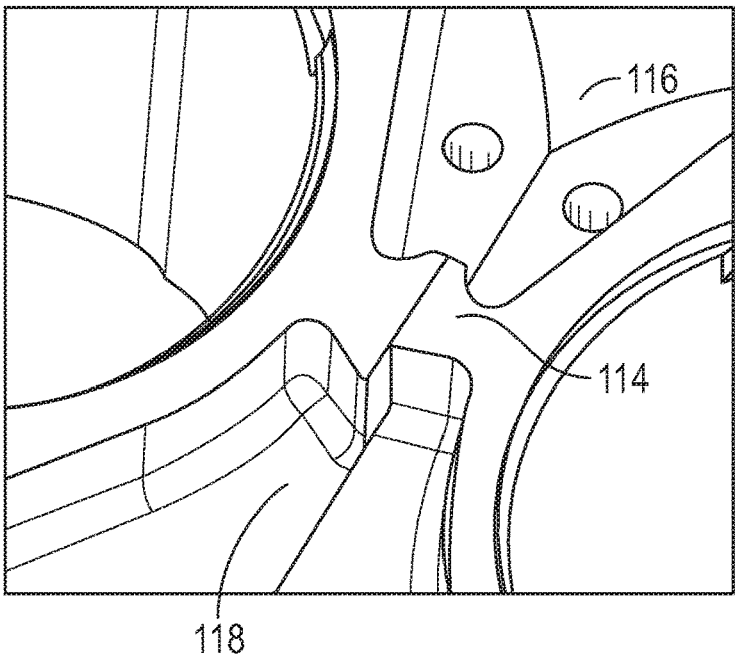

As shown in FIG. 1, a typical gear pump has two external teeth gears 100, 102, one drive (100) and one driven (102), received on respective first (drive) shaft 104 and second (driven) shaft 106 (FIGS. 1A-1B. There are two sets of bearings 110, 112. Particularly, the first or upper (as illustrated) bearing 110 includes bearing portions 110A, 110B that support the first and second shafts 104, 106, respectively, and similarly, the second or lower (as illustrated) bearing 112 includes bearing portions 112A, 112B (FIGS. 1A and 1C) that also support the first and second shafts 104, 106. The bearings 110, 112 are located on either side of the gears 100, 102 (e.g., as illustrated, above and below although this orientation of the shafts, gears and bearings is exemplary only and should not be deemed limiting). The bearings 110, 112 on each side are preferably of split design as shown. There is a middle feature on the bearings 110, 112 which is called a bearing dam 114. The bearing dam 114 prevents high pressure fluid on the discharge side 116 directly leaking to the low-pressure inlet side 118 of the gear pump (FIG. 1D).

Figure 2:
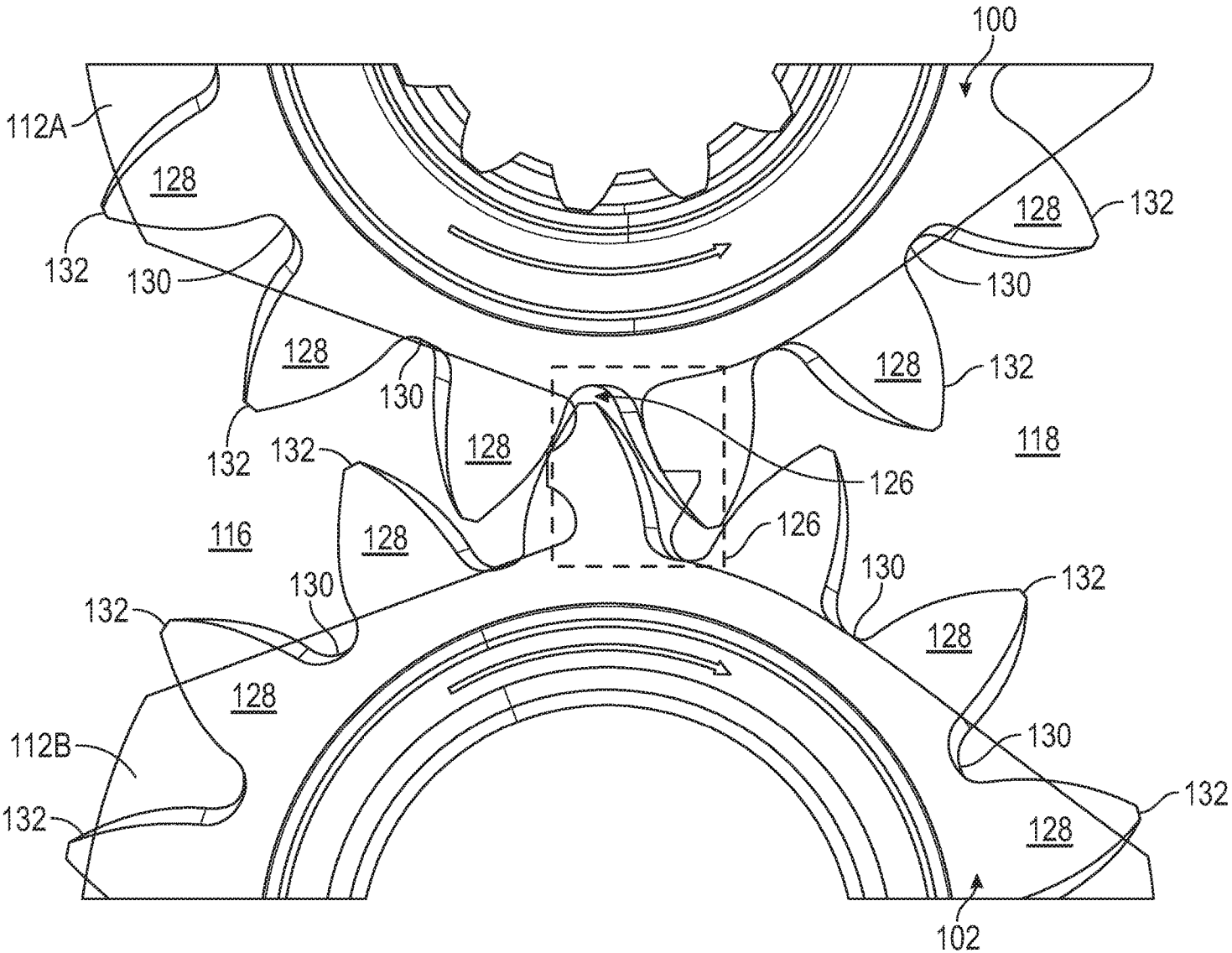
FIG. 2 illustrates the gears and bearing dam timing in a typical gear pump.

FIG. 2 shows a planar view of the drive and driven gears 100, 102 and bearings 112A, 112B with a time event such that gear carryover volume 126 has started opening up to the (low-pressure) inlet side 118. Due to the suction created at the intermeshing gear teeth 128, particularly at roots 130 of the drive gear 100 location (mid-location along the gear width), there is cavitation in that region which ends up causing erosion of drive gear roots 130 and driven gear tips 132 in the mid-location.

Figure 3A:
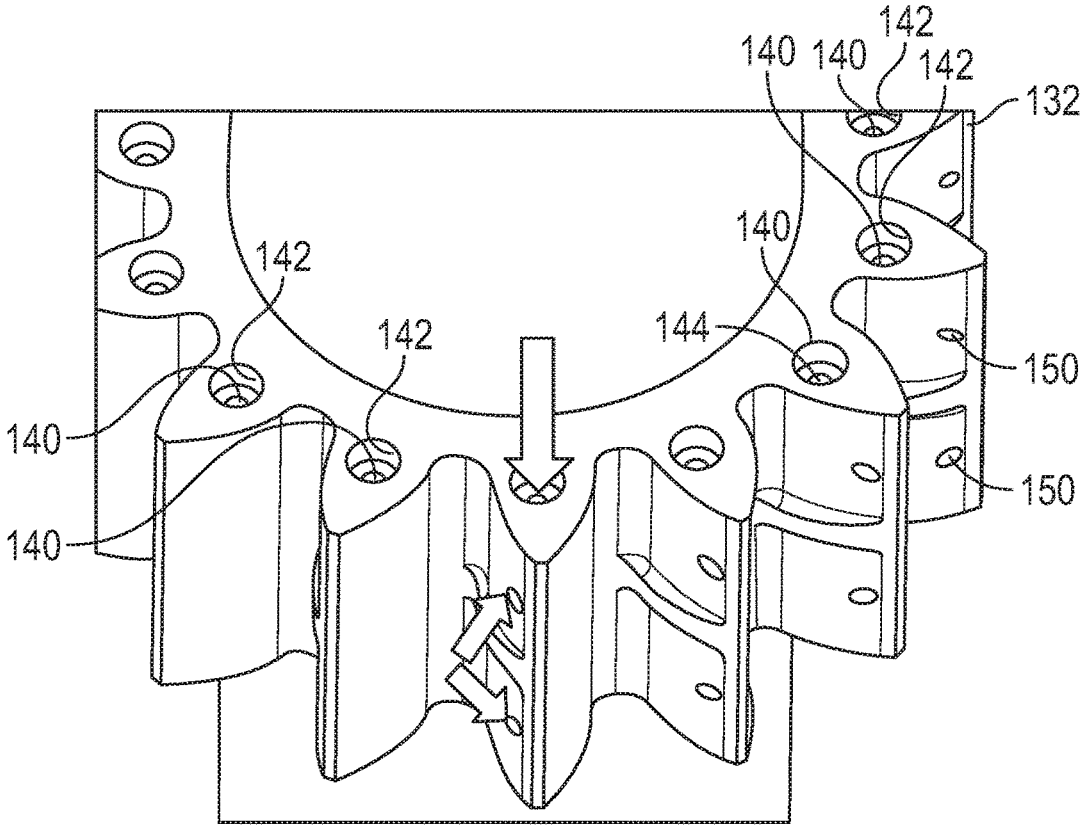
FIGS. 3A-3B illustrate the high pressure ported bleed feature of a driven gear of the present disclosure.
Figure 3B:
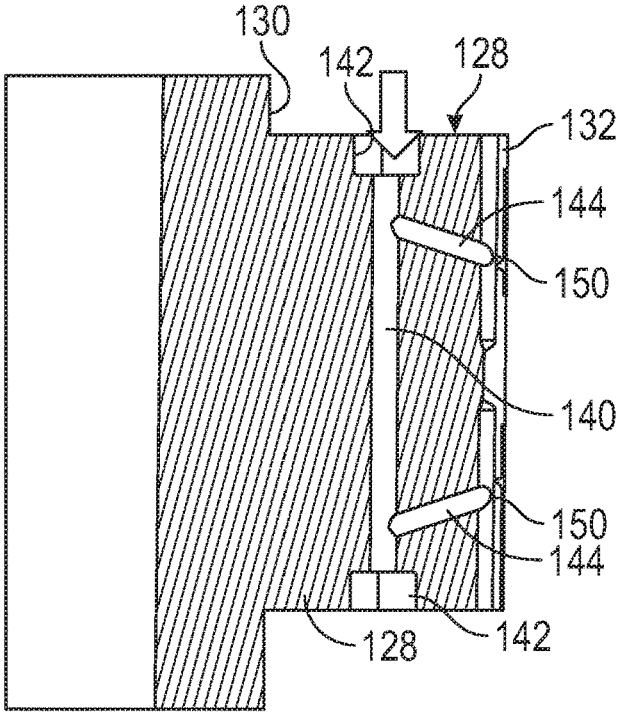

FIGS. 3A-3B show a proposed concept of a driven gear 102 with detailed features. Drilling or similar operations are needed to provide the design features such that there will be through holes 140 (openings or passages) on the gear teeth 128 in an axial direction and the through holes are provided with counter bores 142, preferably larger diameter counter bores. By controlling the location and size of these larger diameter counter bores 142, the counter bores serve as porting timing with discharge pressure to the bleed feature. A cross-sectional view of the gear tooth 128 (FIG. 3B) shows two inclined holes or passages 144 on the gear non-working face which are connected to the main through hole 140 in an axial direction. The internal fluid path cavity formed by the combined through hole 140 and inclined passages 144 through each gear tooth 128 serves as a mechanism with which high pressure fluid from the discharge side 116 is supplied to the inlet side 118 of the gear intermesh 126 when needed. The bearing dam timings, gear profiles and bleed feature timings decide the overall effectiveness of the bleed mechanism, and as one skilled in the art will appreciate, variations in the timings of the bearing dams 114, the profiles of the gears 100, 102, and the bleed feature timings provide the desired addition of high pressure fluid (from the discharge side 116) to the gear intermesh region 126 to address the need for additional fluid that minimizes or limits gear intermesh starvation and/or cavitation that otherwise results in this region.

Figure 4:
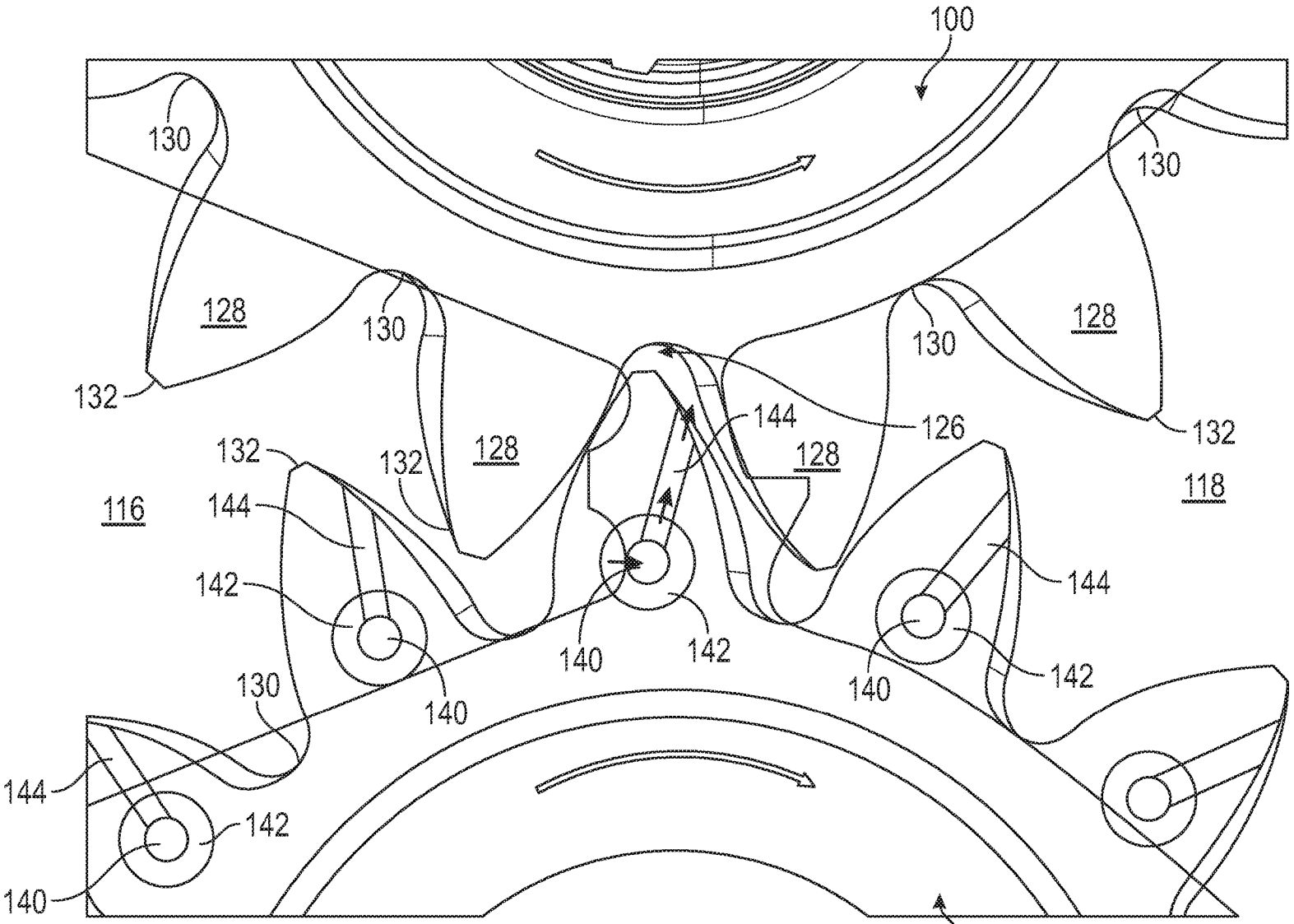
FIG. 4 illustrates the gears and bearing dam timing in a gear pump of the present disclosure.

In FIG. 4, the workings of a proposed bleed mechanism for the driven gear 102 is illustrated and like reference numerals are used to refer to like components for purposes of brevity and ease of reference, while new reference numerals refer to new components. At similar timing as that in a typical gear pump (FIG. 2), with a driven gear 102 bleed mechanism, high pressure fluid from the discharge side 116 is ported through the mechanism and is supplied to the gear intermesh 126. Two inclined passages 144 which are provided on the non-working faces of the driven gear 102 allow the bleed flow to be directed towards a mid-location along the gear width (i.e., between the gear root 130 and gear tip 132). This arrangement also allows bearing port flow to flow naturally in the gear mesh 126 which further avoids gear intermesh cavitation.

Figure 5:
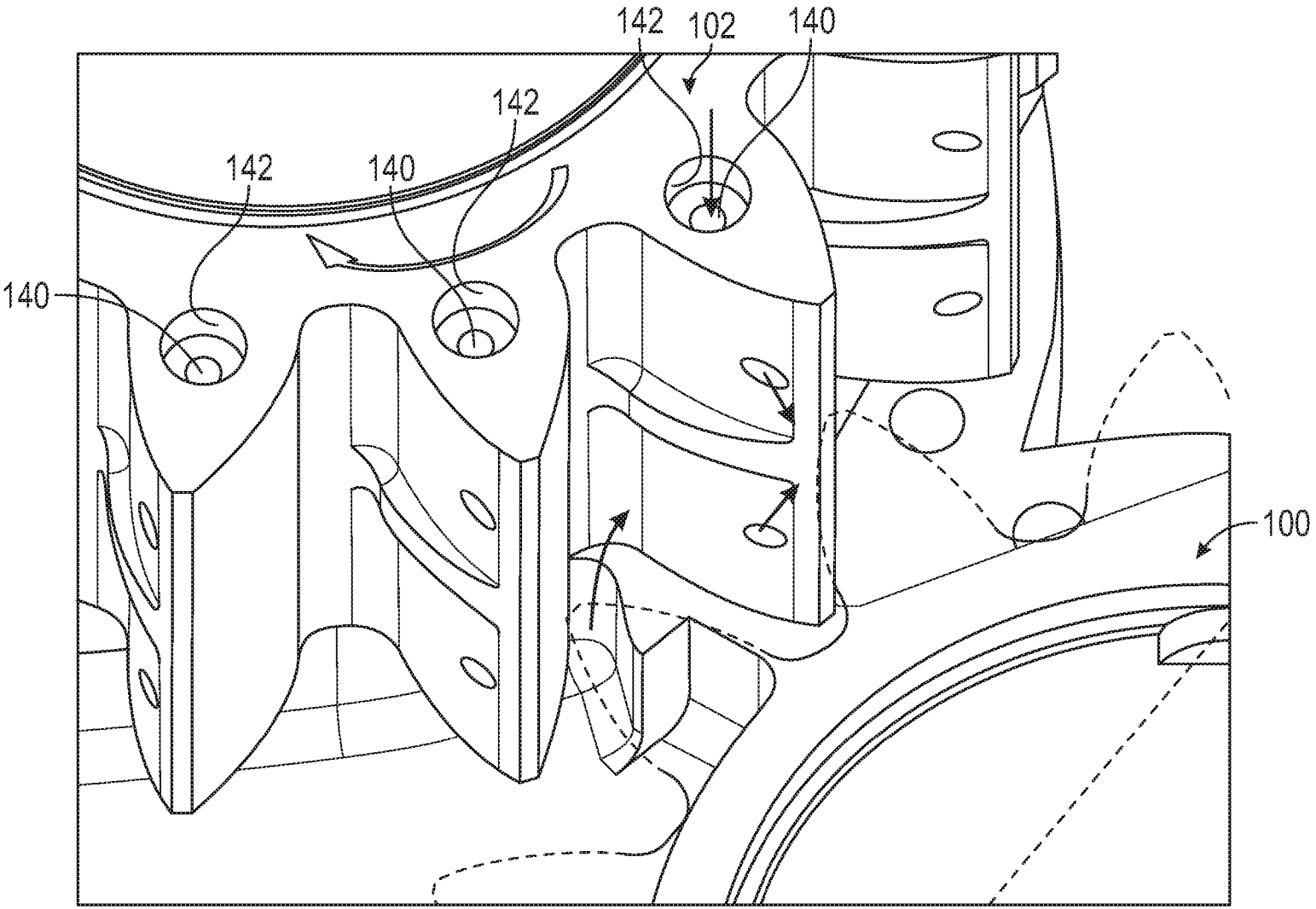
FIG. 5 illustrates the gear and bearing timings associated with a driven gear having ported flow of the present disclosure.
Figure 6A:
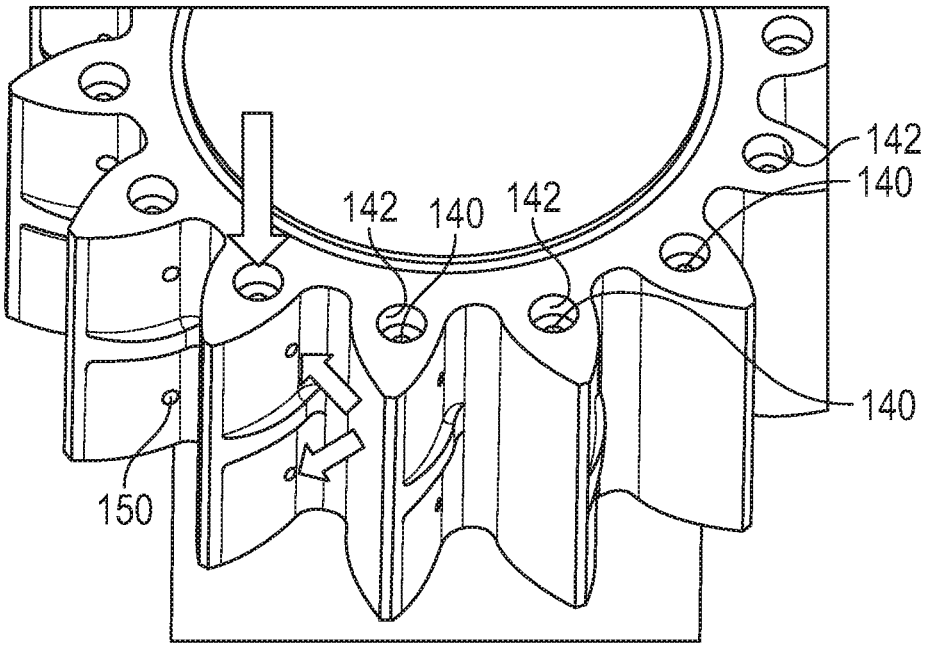
FIGS. 6A-6B illustrate the inlet pressure ported bleed of the drive gear of the present disclosure.
Figure 6B:
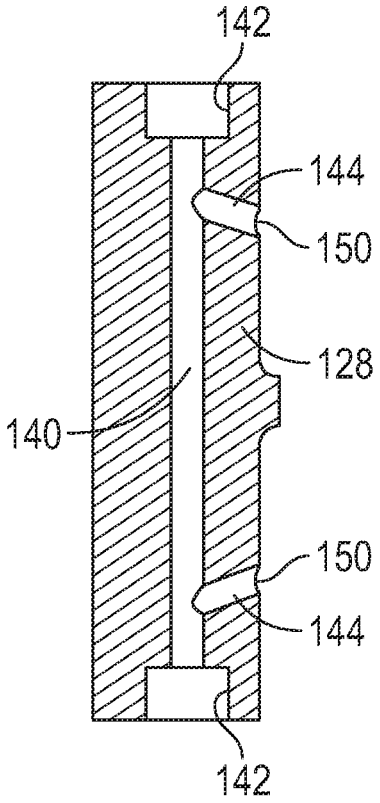

FIG. 5 shows an isometric view of the driven gear 102 (drive gear 100 outline shown in broken lines), depicting high pressure porting 150 from the gear side faces and induced bearing in-flow into the gear intermesh 126. The high pressure porting 150 communicates with the through hole 140 and counter bores 142 as shown and described in connection in FIGS. 3A-3B. Timings of the driven gear 102 bleed mechanism are important as this decides the amount of bleed flow provided to avoid cavitation and erosion. The enlarged, unnumbered reference arrows leading from the bleed flow porting 150 in the non-working face of the teeth 128 of the driven gear 102 illustrate a general direction of the high pressure bleed flow into the gear intermesh 126 to address the need for additional fluid that minimizes or limits gear intermesh starvation and/or cavitation that otherwise results in this region FIGS. 6A-6B show a proposed concept of the drive gear 100 with detailed features. Again, for purposes of brevity and consistency, like reference numerals refer to like components, and new reference numerals are used to identify new features or components. Drilling or similar operations (e.g., additive manufacturing techniques) are needed to provide the design feature for the bleed mechanism such that there will be through holes or passages 140 on the gear teeth in an axial direction and the through holes will be provided with larger diameter counter bores 142 (FIG. 6B). These larger diameter counter bores 142 serve as porting timing with inlet pressure to the bleed feature. A cross-sectional view (FIG. 6B) of the gear tooth 128 shows the two inclined drill holes 144 on the gear non-working face which connect to the main through hole 140 in an axial direction. The internal fluid path cavity (counterbore 142, through hole 140, inclined passages 144, porting/outlet 150) through each gear tooth 128 serves as a mechanism with which fluid from the lower pressure inlet side 118 is supplied to the gear intermesh 126 when needed. The bearing dam 114 timings, gear profiles and bleed feature timings decide the effectiveness of the bleed mechanism.

Figure 7:
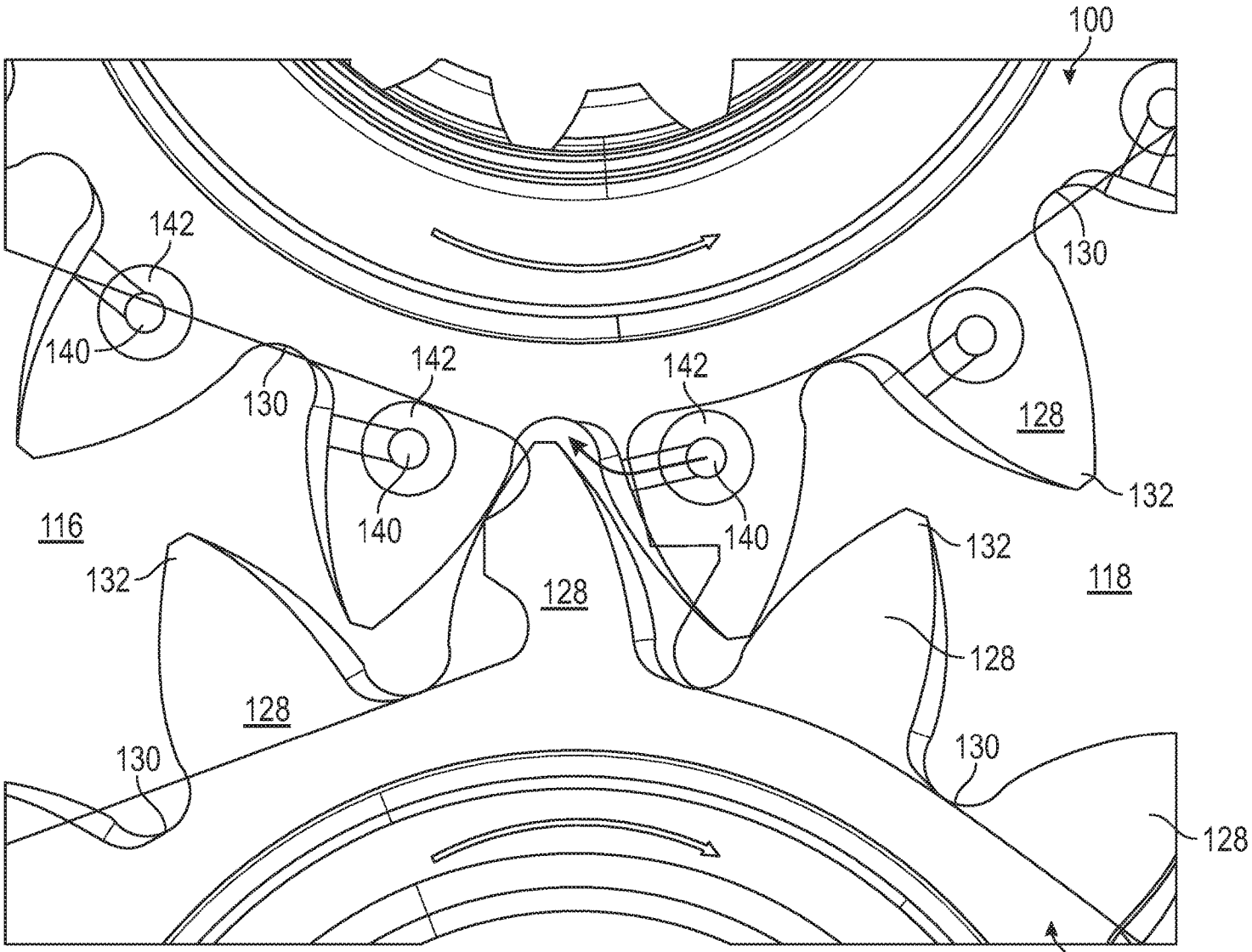
FIG. 7 shows the gear and bearing timings associated with a gear pump of the present disclosure.

In FIG. 7, the working of a proposed bleed mechanism on the drive gear 100 is illustrated. At a similar timing as that in a typical gear pump (FIG. 2), with a drive gear bleed mechanism, lower pressure fluid from the inlet side 118 is ported through the mechanism (counter bores 142, through holes 140, inclined passages 144, and porting 150) and is supplied to the gear intermesh 126. Two inclined openings 150 which are provided on the non-working faces of the drive gear allow the bleed flow to be directed toward the mid-location along the gear width (i.e., between the root 130 and tip 132 of a tooth 128). This allows bearing port flow to flow naturally in the gear mesh 126 which further avoids gear intermesh cavitation.

Figure 8:
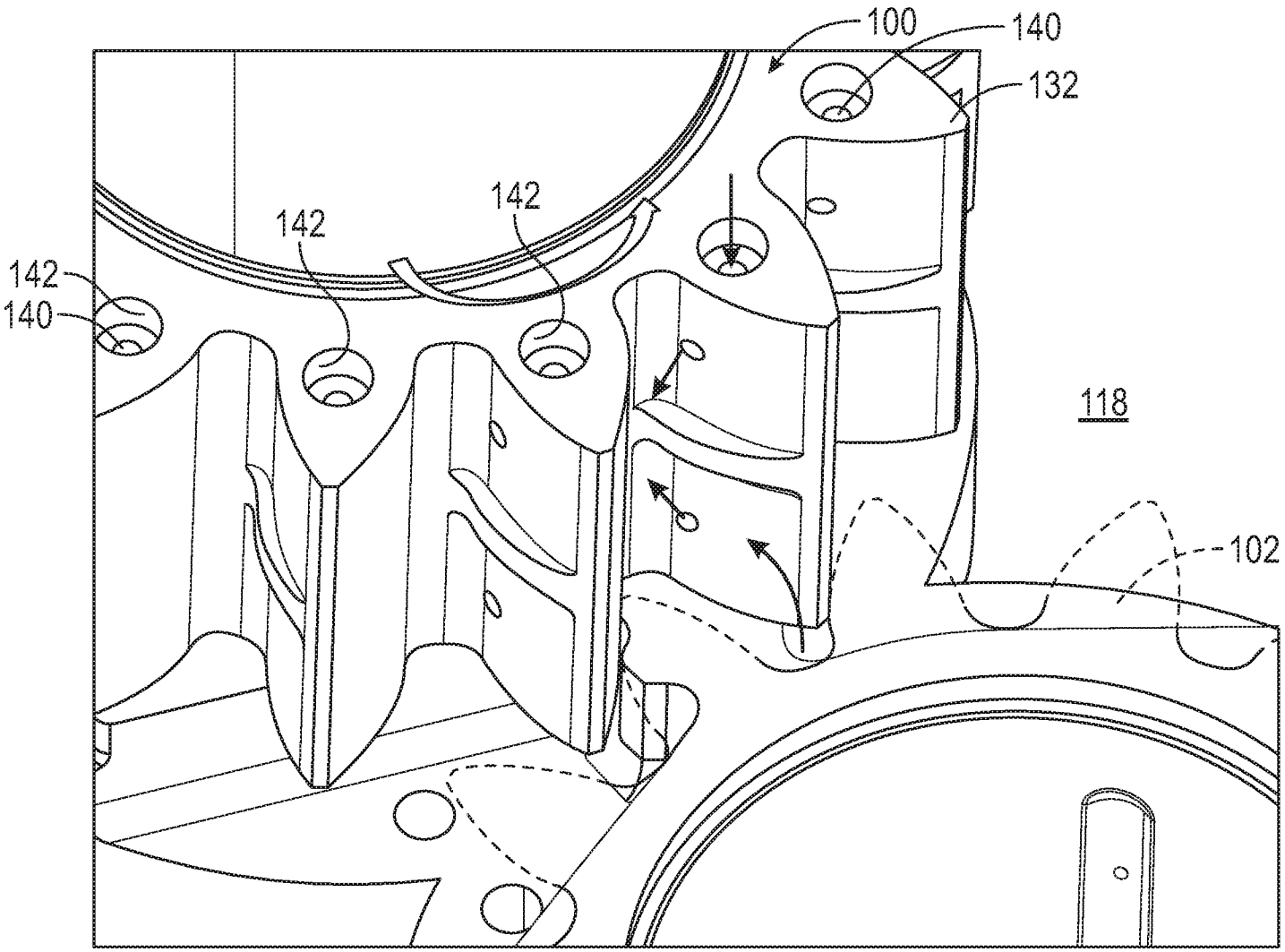
FIG. 8 shows the ported flow of the drive gear of the gear and bearing timings in a gear pump of the present disclosure.

FIG. 8 shows an isometric view of the drive gear 100 (driven gear 102 outline is shown in broken lines), depicting high pressure porting 150 from gear side faces and induced bearing inflow into the gear intermesh 126.

Figure 9:
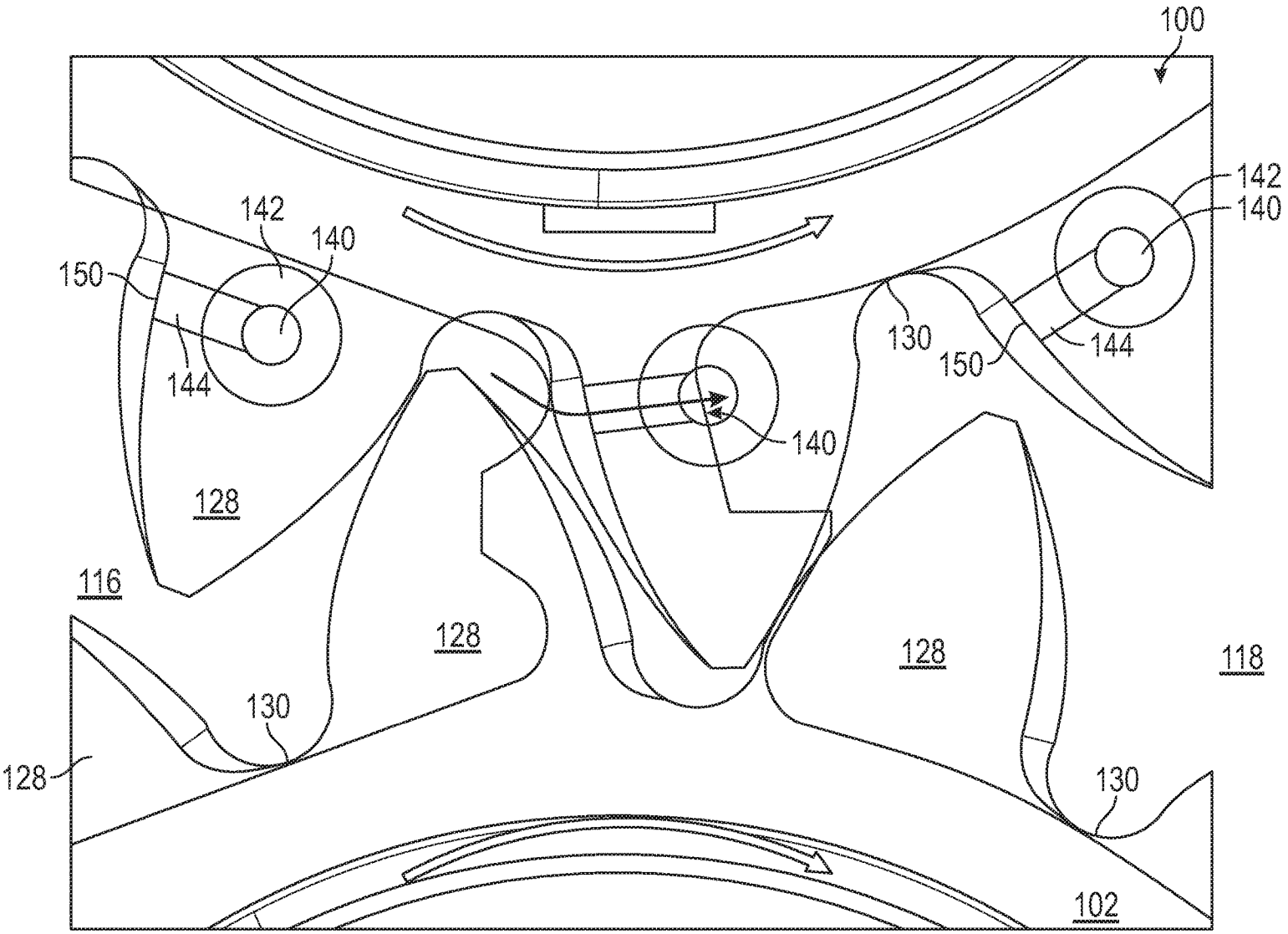
FIG. 9 conceptually illustrates extra leakage with the drive gear bleed feature.

Timings of the drive gear 100 bleed mechanism are important as it decides the amount of bleed flow provided to avoid cavitation and erosion. Due to the addition of drive gear bleed features (140, 142, 144, 150), it is expected that overall leakage would increase. Especially as shown in FIG. 9, the drive gear bleed mechanism may lead to an extra leakage than usual. To avoid additional leakage, either the inlet side or discharge side bearing dam timings can be adjusted.

Figure 10A:
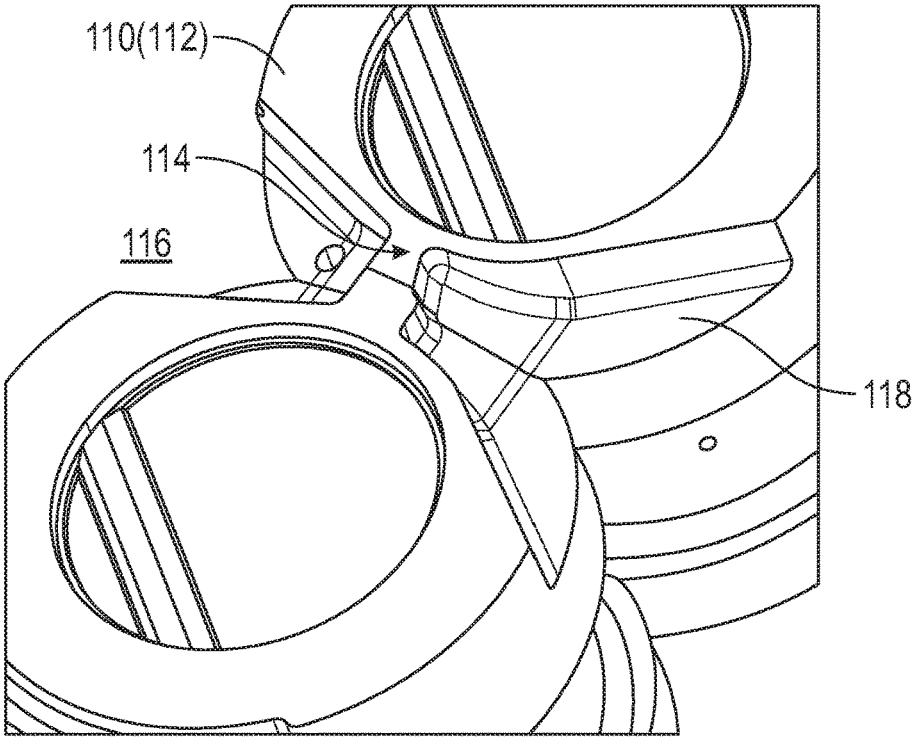
FIGS. 10A-10B are views of a traditional gear pump porting.
Figure 10B:
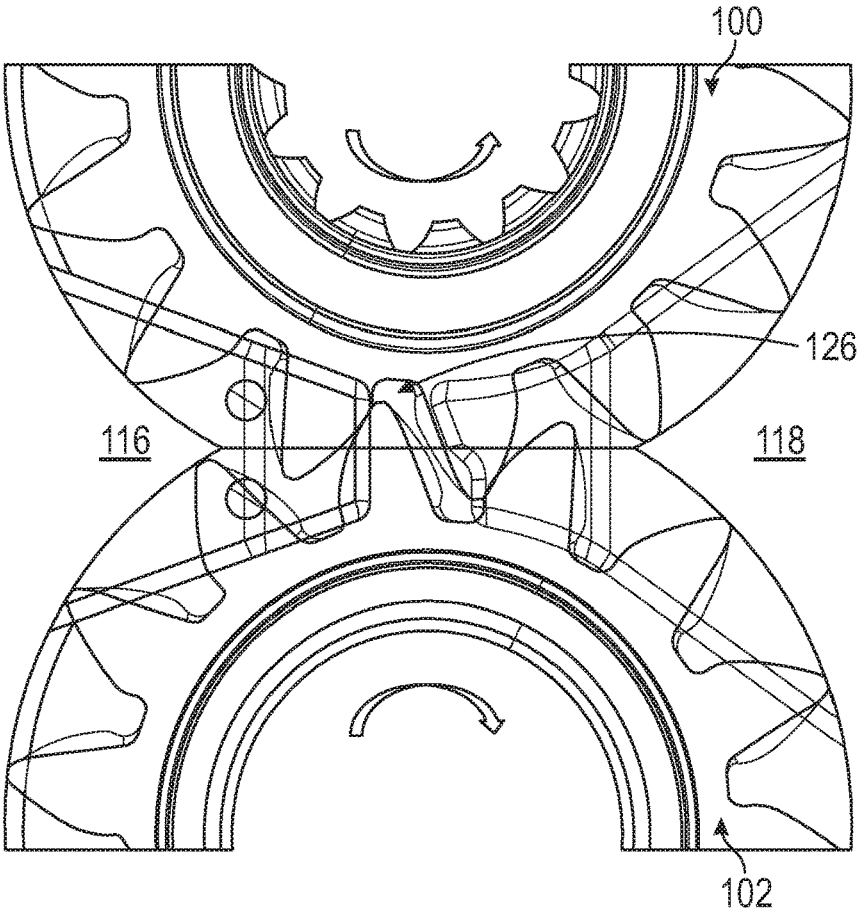

Gear pumps traditionally are prone to cavitation due to the short amount of time available to fill the gear mesh. FIGS. 10A, 10B show the inlet and discharge porting areas within the gear mesh for a traditional pump. These porting areas within the gear mesh may be changed but a limited area is available to fill the mesh. As gear pumps get larger and rotate faster, this filling becomes more challenging and tends to result in larger amounts of cavitation.

Figure 11A:
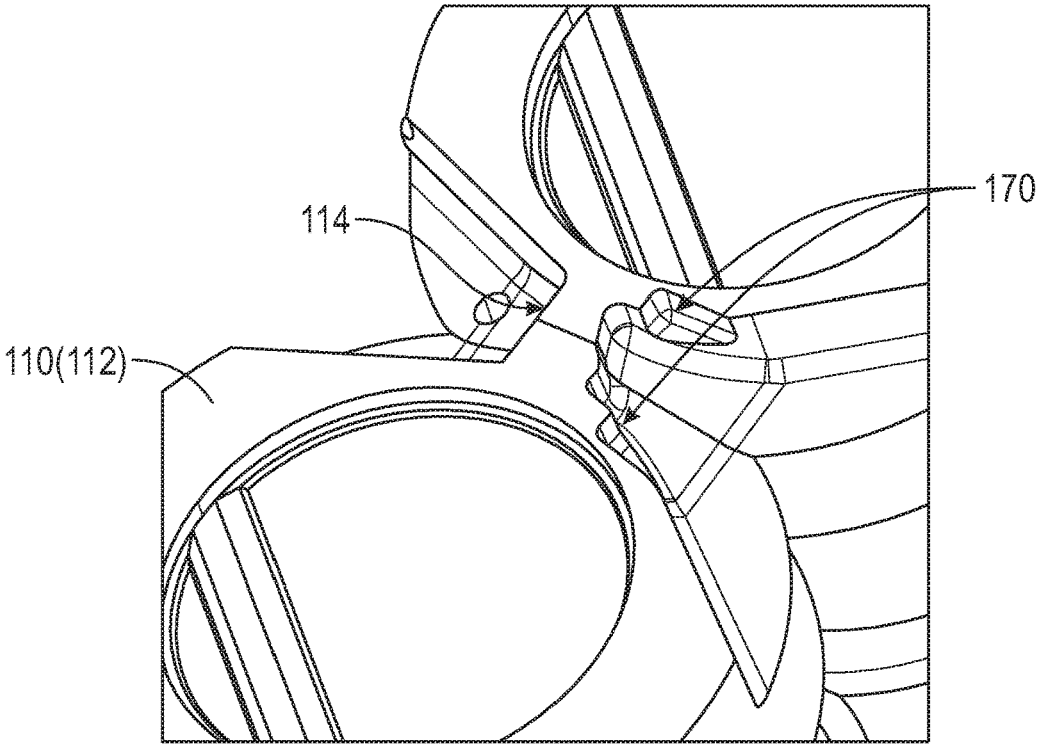
FIGS. 11A-11C illustrate inlet porting only in one version of gear root and side porting of a gear pump of the present disclosure.
Figure 11B:
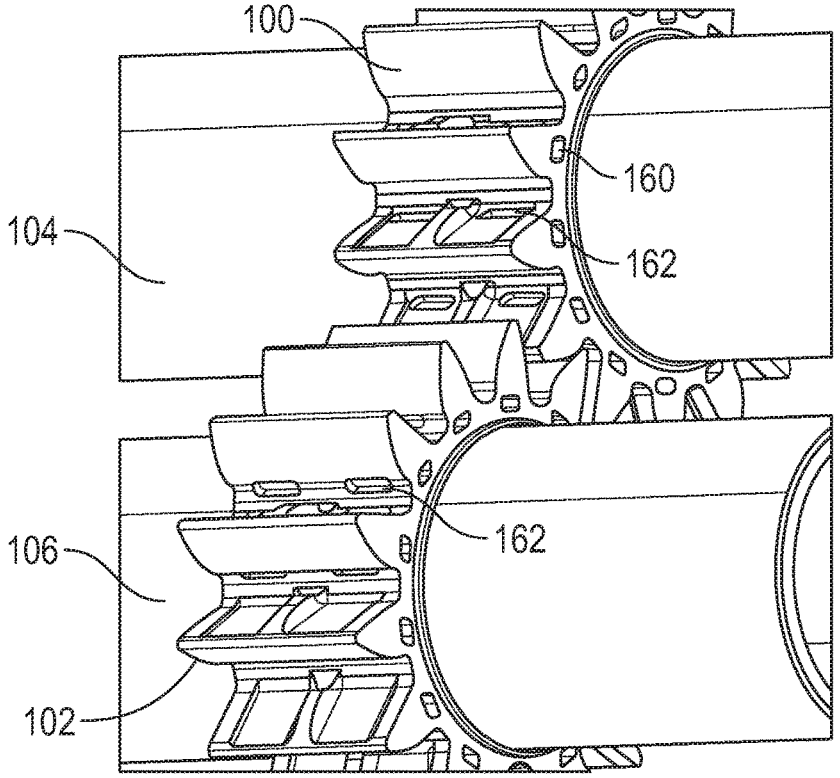
Figure 11C:
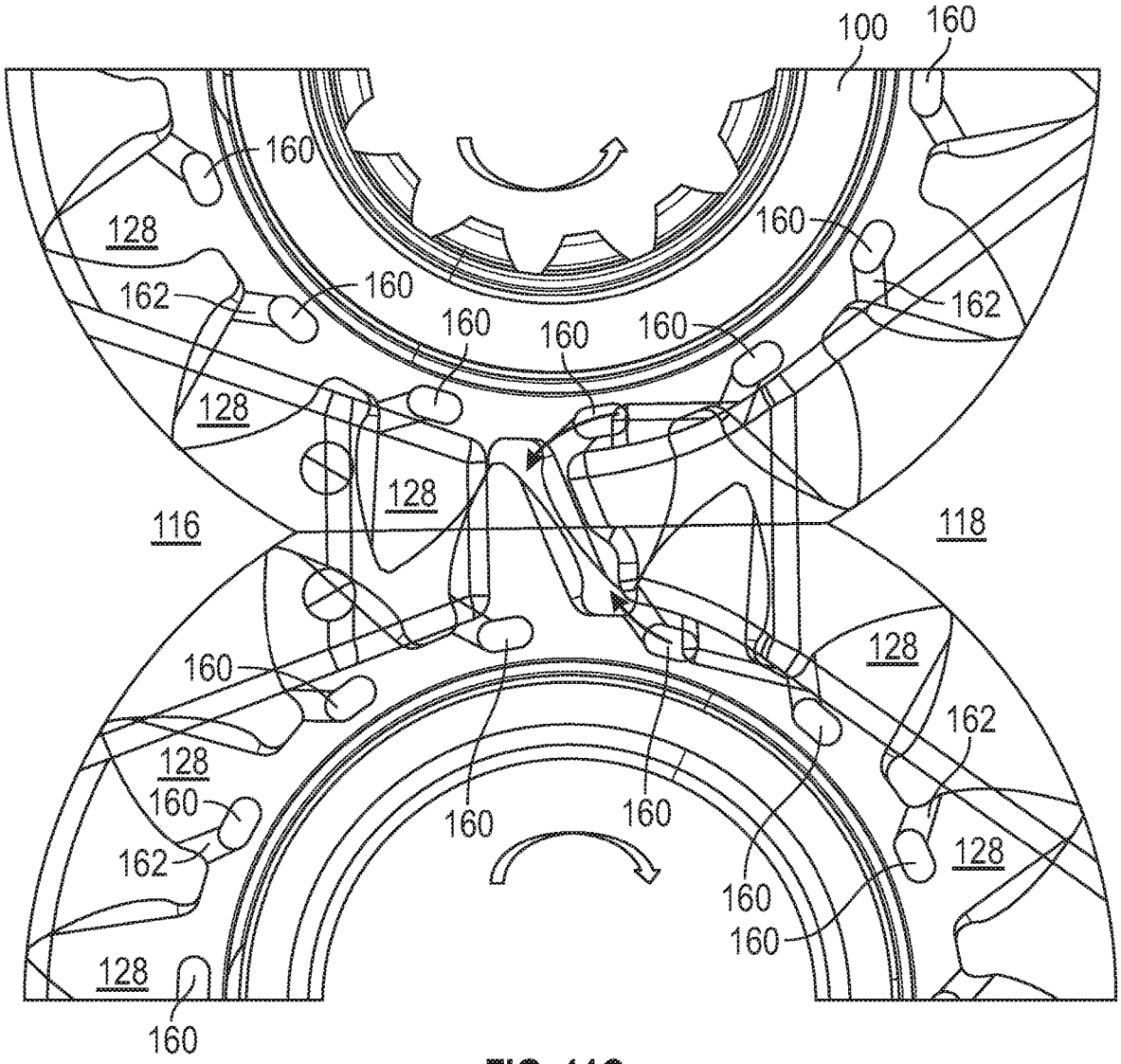

A new arrangement and method are shown in FIGS. 11A-11C (gear root and side porting—inlet porting only) which uses axial slots 160 that communicate with additional connecting passages 162 on the sides of the gear teeth to provide filling area and a flow path to the center of the gear mesh. The axial slots 160 are in selective fluid communication with timing slots 170 (perhaps best illustrated in FIG. 11A) on the inlet side only in this embodiment. It is believed that this type of timing has not been utilized in gear pumps. The placement of axial holes/slots 160 in the gear teeth ensures proper sealing against the bearings 110, 112 and ensure the gear teeth 128 are structurally sound. Once these axial holes/slots 160 are provided at desired locations, then connecting passages 162 are provided at the bottom of the gear tooth 128 profile, ideally in the gear root 130. These connecting passages 162 may be simple slots as shown in FIGS. 11A-11C or may be angled (as previously described in connection with other preferred embodiments shown in FIGS. 3-9) to direct the flow rate either toward the center of the gear mesh 126 or toward the bearing 110, 112 faces. This is important to address filling in different areas to mitigate cavitation. As seen in FIGS. 11A-11C, these gear root slots or connecting passages 162 are placed on opposite sides of the gear teeth 128 relative to the drive gear 100 and driven gear 102. This configuration provides additional filling to the gear mesh 126 from the inlet side 118 of the pump. Often this is the important side to improve filling due to low inlet pressures.

Figure 12A:
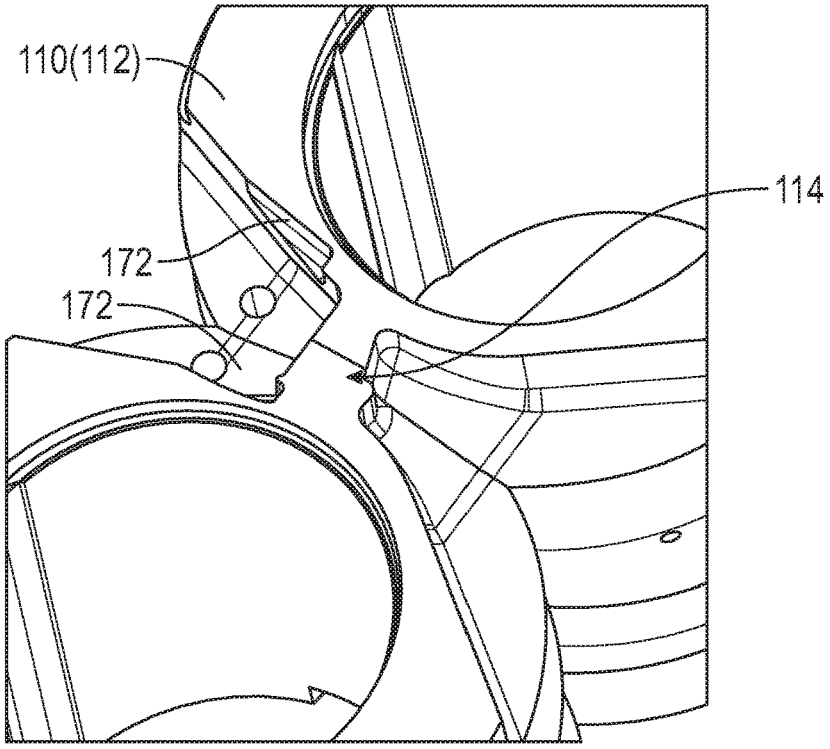
FIGS. 12A-12C illustrate discharge porting only in another version of gear root and side porting of a gear pump of the present disclosure.
Figure 12B:
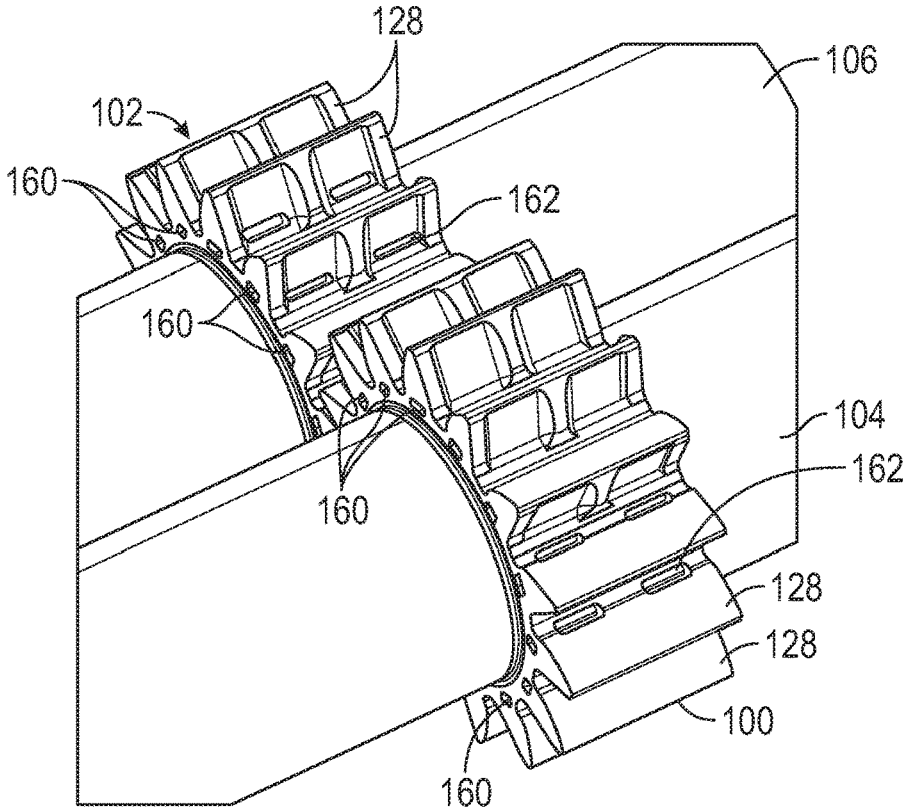
Figure 12C:
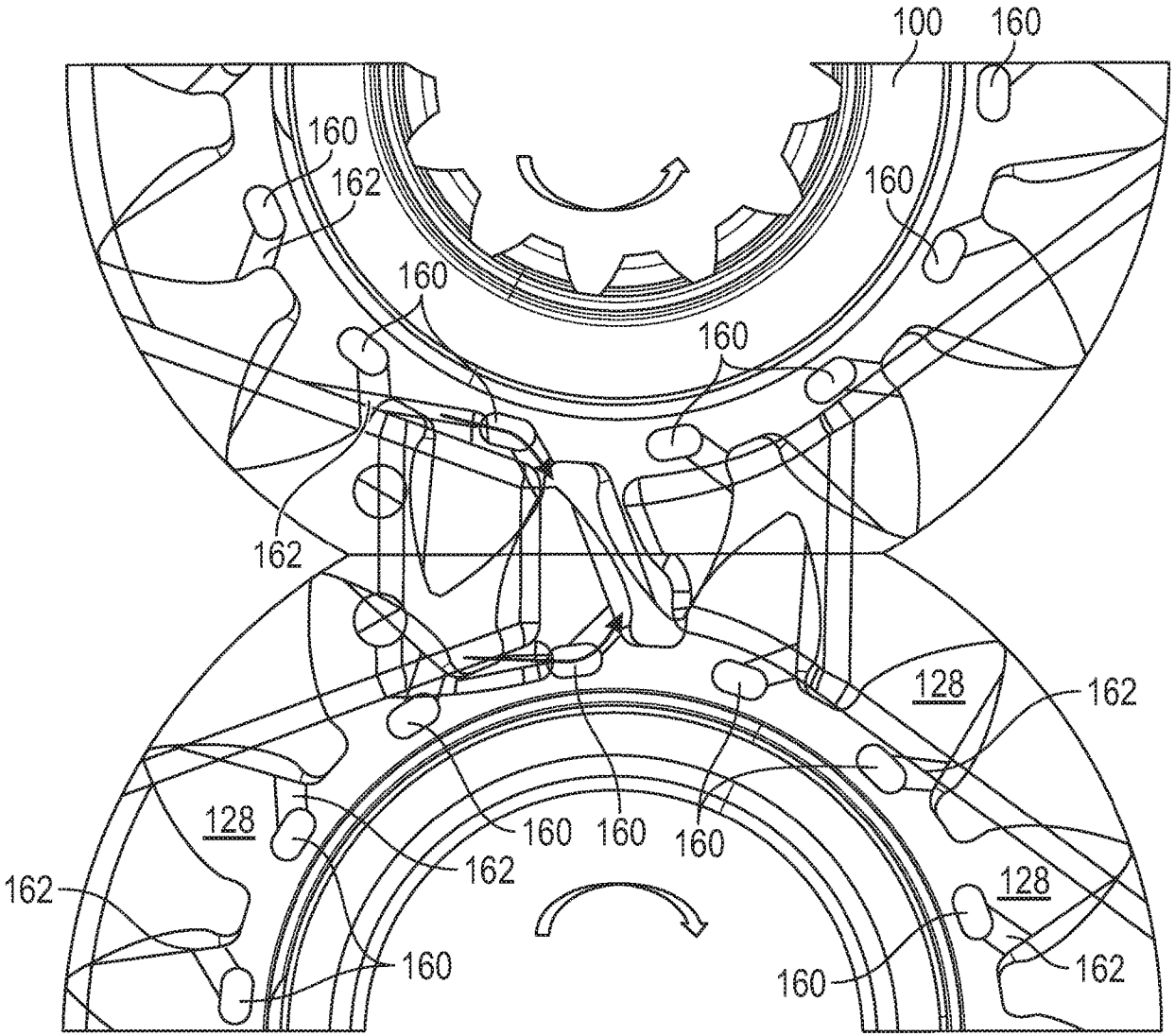
Figure 13A:
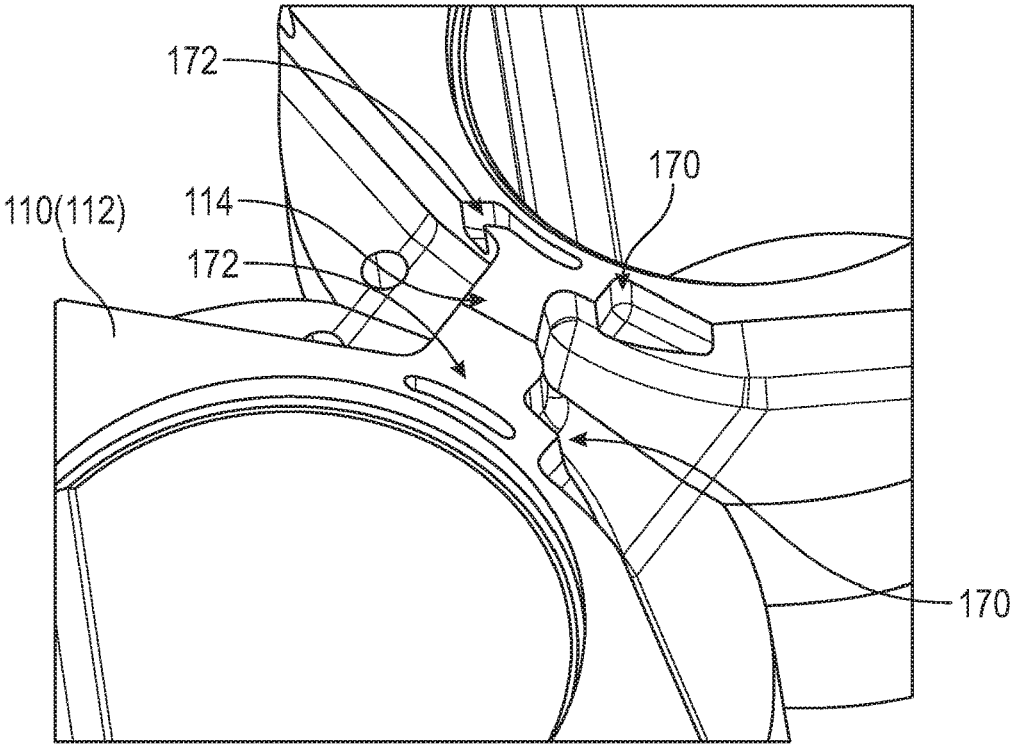
FIGS. 13A-13C illustrate both inlet and discharge porting in a further version of gear root and side porting of a gear pump of the present disclosure.
Figure 13B:
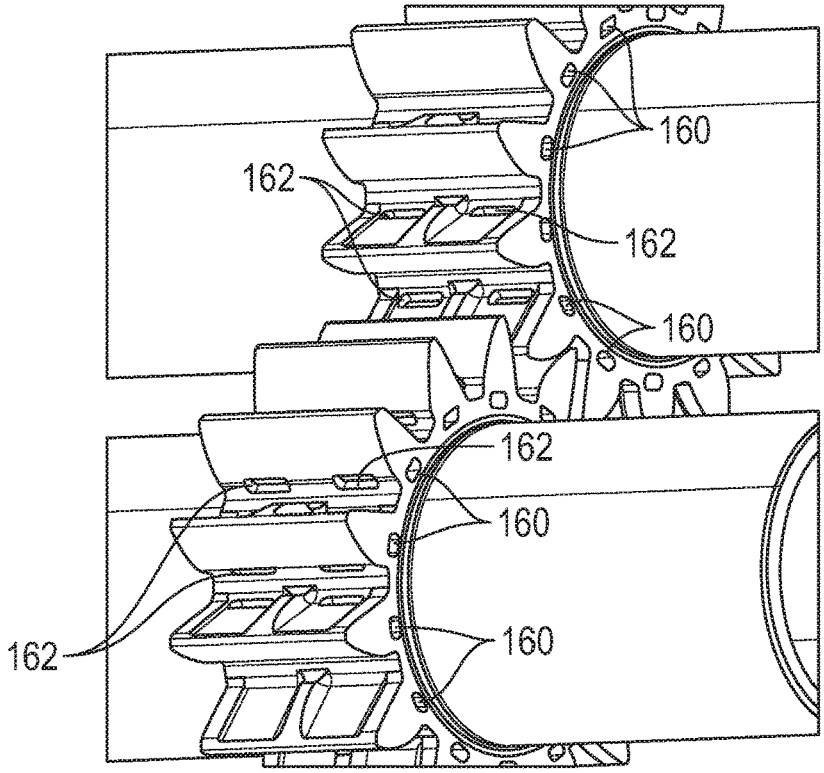
Figure 13C:
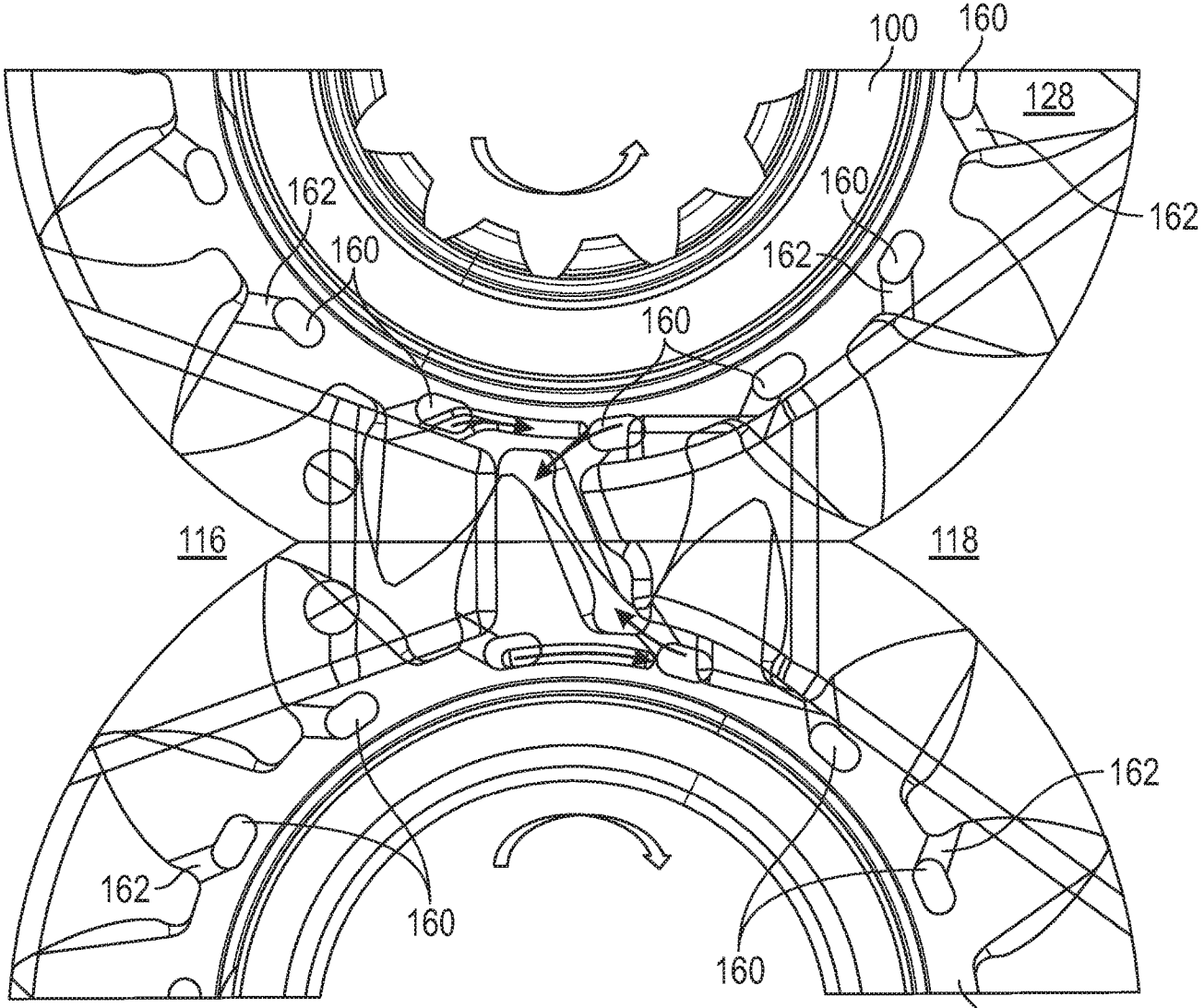

Alternate configurations are shown in FIGS. 12A-12C (gear root and side portion—discharge porting only) and 13A-13C (gear root and side porting—inlet portion and discharge porting). FIGS. 12A-12C show gear mesh 126 filling through this gear root 130 and side filling from the discharge side 116 (note timing slots 172 on the discharge side 116 in FIG. 12A). FIGS. 13A-13C show porting and additional timing slots 170 on the inlet side of the bearing 110, 112 adjacent the bearing dam 114 (compare FIG. 10A for a traditional gear pump porting with the additional porting 170 on the side/root from both the inlet side 118 and the additional porting 172 on the discharge 116 in FIG. 13A), thus providing bleed flow ideally to the gear root or to the side faces of both the drive gear 100 and the driven gear 102 in a manner akin to the previously described embodiments of FIGS. 3-9. This configuration shown in FIGS. 13A-13C is the most general approach and allows additional opportunities to improve the gear pump. By porting 170, 172 to both the inlet and discharge sides 118, 116, respectively, and setting timing to ensure minimal cross-porting, the inlet filling can be addressed as mentioned previously to mitigate cavitation but also some cavitation benefit can be gained from the discharge side 116 as well. This benefit is the reduction in the maximum pressure within the gear mesh 126. Traditional gear pumps have an elevated pressure in the gear mesh 126 just prior to transitioning to inlet pressure. This is a result of the minimal porting area available on the discharge side 116—a similar problem as the inlet. An overall reduction in the gear mesh pressure helps to reduce cavitation. An additional benefit to this porting is also the ability to tune this geometry to change the inlet discharge flow ripple due to the pressure developed in the gear mesh 126. This porting can be used to generate a more gradual transition from the discharge side to the inlet side thus reducing flow ripple and potentially system pressure ripple.

This written description uses examples to describe the disclosure, including the best mode, and also to enable any person skilled in the art to make and use the disclosure. Other examples that occur to those skilled in the art are intended to be within the scope of the invention if they have structural elements that do not differ from the same concept, or if they include equivalent structural elements with insubstantial differences.

Although specific advantages have been enumerated above, various embodiments may include some, none, or all of the enumerated advantages. Although exemplary embodiments are illustrated in the figures and description herein, the principles of the present disclosure may be implements using any number of techniques, whether currently known or not. Moreover, the operations of the system and apparatus disclosed herein may be performed by more, fewer, or other components and the methods described herein may include more, fewer or other steps. Additionally, steps may be performed in any suitable order.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

We claim:

1. A gear pump assembly comprising:

a drive gear having a plurality of circumferentially spaced teeth;

a driven gear having a plurality of circumferentially spaced teeth that mesh with the teeth of the drive gear whereby rotation of the drive gear results in rotation of the driven gear;

a bearing dam that directs a carryover volume from a discharge side of the pump assembly to an inlet side of the pump assembly;

a bleed mechanism that supplies bleed fluid flow to the carryover volume disposed between mating drive gear teeth and driven gear teeth, the bleed mechanism including a passage in at least one of the drive gear and driven gear teeth, the passage includes at least one first passage portion extending through the teeth of the drive gear and/or driven gear, the first passage portion having an opening in an axial end of at least one of the drive gear and the driven gear, and the first passage portion extends in a direction substantially parallel to opposite faces of the teeth of the drive and/or driven gear, the passage further communicating with at least one of:

(i) a non-working gear face of the drive gear, (ii) a non-working gear face of the driven gear; or (iii) a bottom of a gear tooth profile adjacent a root region between adjacent gear teeth;

the bleed mechanism further including a counter bore portion at the axial opening, the counter bore portion timing the bleed fluid flow to the bleed mechanism passage;

the bleed mechanism passage receiving the bleed fluid flow at the counter bore before directing the bleed fluid flow toward the gear mesh.

2. The gear pump assembly of claim 1 wherein the passage includes a second passage portion communicating at a first end with the first passage portion within the drive and/or driven gear teeth, and communicating at a second end with a face of the teeth of the drive and/or driven gear, respectively.

3. The gear pump assembly of claim 2 wherein the second passage portion is inclined relative to normal to one of the faces of the teeth of the drive and/or driven gear.

4. The gear pump assembly of claim 2 wherein the second passage portion communicates with a non-working, trailing face of the gear teeth.

5. The gear pump assembly of claim 2 wherein the second passage portion includes first and second openings that are inclined relative to normal to one of the faces of the teeth of the drive and/or driven gear.

6. The gear pump assembly of claim 5 wherein the first and second openings of the second passage portion converge toward one another.

7. The gear pump assembly of claim 1 wherein the counter bore portion is enlarged, the counter bore portion disposed at an inlet end of the first passage portion that communicates with the inlet side of the gear pump.

8. The gear pump assembly of claim 1 wherein the bleed mechanism passage includes an axial slot that communicates with a side of the teeth at one end and that communicates with the root region disposed between adjacent gear teeth at the bottom of the gear tooth profile.

9. The gear pump assembly of claim 8 wherein the bleed mechanism passage is in the drive gear, the bleed mechanism passage of the drive gear receives the bleed fluid flow from the inlet side of the pump via the axial opening before directing the bleed fluid flow toward a center of the gear mesh.

10. The gear pump assembly of claim 8 wherein the bleed mechanism passage includes a connecting portion at the bottom of the gear tooth profile.

11. The gear pump assembly of claim 10 wherein the connecting portion is angled to direct the bleed flow toward a face of the bearing dam.

12. The gear pump assembly of claim 1 wherein the passage includes a second passage portion communicating at a first end with the first passage portion within the drive and/or driven gear teeth and the second passage portion communicates with a trailing face of the gear teeth; and wherein the passage extends from the axial opening in the teeth of the drive gear to the trailing face of the drive gear teeth, or wherein the passage extends from the axial opening in the teeth of the driven gear to the trailing face of the driven gear teeth.

13. The gear pump assembly of claim 10 wherein the connecting portion extends from the axial slot in the teeth of the driven gear to a leading face of the driven gear teeth.

14. The gear pump assembly of claim 10 wherein the connecting portion extends from the axial slot in the teeth of the drive gear to a leading face of the drive gear teeth.

15. The gear pump assembly of claim 1 wherein the passage includes a second passage portion communicating at a first end with the first passage portion within the drive and/or driven gear teeth;

wherein the second passage portion communicates with a trailing face of the gear teeth; and wherein the connecting portion extends from an axial slot in the teeth of the drive gear to the trailing face of the drive gear teeth.

16. The gear pump assembly of claim 15 wherein the connecting portion extends from the axial opening in the teeth of the driven gear to the trailing face of the driven gear teeth.

17. The gear pump assembly of claim 10 further comprising timing slots in bearing end faces to control flow into the axial opening.

18. The gear pump assembly of claim 17 wherein the timing slots in the bearing end faces are provided in both an inlet side and discharge side of the bearing dam that separates the inlet side and discharge side of the pump assembly.

19. A gear pump assembly comprising:

a drive gear having a plurality of circumferentially spaced teeth;

a driven gear having a plurality of circumferentially spaced teeth that mesh with the teeth of the drive gear whereby rotation of the drive gear results in rotation of the driven gear;

a bearing dam that directs a carryover volume from a discharge side of the pump assembly to an inlet side of the pump assembly;

a bleed mechanism that supplies bleed fluid flow to the carryover volume disposed between mating drive gear teeth and driven gear teeth, the bleed mechanism including:

a passage in at least one of the drive gear and driven gear teeth, the passage includes at least one first passage portion extending through the teeth of the drive gear and/or driven gear, the first passage portion having an opening in an axial end of at least one of the drive gear and the driven gear, and the first passage portion extends in a direction substantially parallel to opposite faces of the teeth of the drive and/or driven gear, the passage further communicating with a side face of at least one of the drive gear and driven gear; and a counter bore portion at the axial opening, the counter bore portion timing the bleed fluid flow to the bleed mechanism passage.

20. A gear pump assembly comprising:

a drive gear having a plurality of circumferentially spaced teeth;

a driven gear having a plurality of circumferentially spaced teeth that mesh with the teeth of the drive gear whereby rotation of the drive gear results in rotation of the driven gear;

a bearing dam that directs a carryover volume from a discharge side of the pump assembly to an inlet side of the pump assembly;

a bleed mechanism that supplies bleed fluid flow to the carryover volume disposed between mating drive gear teeth and driven gear teeth, the bleed mechanism including a passage in at least one of the drive gear and driven gear teeth, the passage includes at least one first passage portion extending through the teeth of the drive gear and/or driven gear, the first passage portion having an opening in an axial end of at least one of the drive gear and the driven gear, and the first passage portion extends in a direction substantially parallel to opposite faces of the teeth of the drive and/or driven gear, the passage further communicating with at least one of:

(i) a gear face of the drive gear, (ii) a gear face of the driven gear; or (iii) a bottom of a gear tooth profile adjacent a root region between adjacent gear teeth; and the bleed mechanism further comprising an enlarged counter bore portion at an inlet end of the first passage portion that communicates with the inlet side of the gear pump.

* * * * *